US011170751B1

(12) United States Patent
Lee et al.

(10) Patent No.: US 11,170,751 B1
(45) Date of Patent: Nov. 9, 2021

(54) ACTIVE NOISE CONTROL FOR VEHICLE WITH A SINGLE OPEN WINDOW

(71) Applicant: Toyota Motor Engineering & Manufacturing North America, Inc., Plano, TX (US)

(72) Inventors: Taehwa Lee, Ann Arbor, MI (US); Xiaopeng Li, St. Louis, MO (US); Jae Seung Lee, Ann Arbor, MI (US); Danil V. Prokhorov, Canton, MI (US); Hideo Iizuka, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 0 days.

(21) Appl. No.: 17/026,758

(22) Filed: Sep. 21, 2020

(51) Int. Cl.
*G10K 11/178* (2006.01)

(52) U.S. Cl.
CPC .. *G10K 11/178* (2013.01); *G10K 2210/12821* (2013.01)

(58) Field of Classification Search
CPC ..... G10K 2210/12821; G10K 11/178
USPC ..... 381/71.4
See application file for complete search history.

(56) References Cited

U.S. PATENT DOCUMENTS

| | | | |
|---|---|---|---|
| 8,584,793 | B2 | 11/2013 | Holzinger |
| 10,239,475 | B2 | 3/2019 | Barnes, III |
| 10,440,480 | B2 | 10/2019 | Butts et al. |
| 10,487,562 | B2 | 11/2019 | Wheeler et al. |
| 2008/0023261 | A1 | 1/2008 | Kaneko et al. |
| 2008/0306660 | A1 | 12/2008 | Campbell et al. |
| 2015/0358727 | A1 | 12/2015 | Rizzo et al. |
| 2016/0221420 | A1 | 8/2016 | Bloss et al. |
| 2019/0066649 | A1 * | 2/2019 | Valeri ..... G10K 11/17823 |

FOREIGN PATENT DOCUMENTS

| | | | |
|---|---|---|---|
| DE | 102016005876 | A1 | 11/2017 |
| EP | 1313090 | A2 | 5/2003 |

* cited by examiner

*Primary Examiner* — Paul Kim
(74) *Attorney, Agent, or Firm* — Christopher G. Darrow; Darrow Mustafa PC

(57) ABSTRACT

A system for actively mitigating a buffeting noise in an occupant compartment of a vehicle when the vehicle is moving. The system is configured to determine an estimated effective volume of the occupant compartment, and to determine if a single window of the vehicle occupant compartment is open. Responsive to a determination that a single window of the vehicle occupant compartment is open, and using the estimated effective volume of the occupant compartment, an estimated buffeting noise frequency is determined. Responsive to the estimated buffeting noise frequency, the system determines characteristics of a sound configured to cancel a buffeting noise generated inside the occupant compartment while the vehicle is moving. The system may then control operation of a noise cancelling signal generating system to generate the sound having characteristics configured to cancel the buffeting noise inside the occupant compartment.

18 Claims, 3 Drawing Sheets

ACTIVE NOISE CONTROL FOR VEHICLE WITH A SINGLE OPEN WINDOW

TECHNICAL FIELD

The subject matter described herein relates to active mitigation and/or cancellation of noise inside a vehicle occupant compartment and, more particularly, to active mitigation and/or cancellation of a buffeting noise which may be produced when a single window or a sunroof of a moving vehicle is opened.

BACKGROUND

An active noise cancellation system may generate a sound configured to cancel a vehicle noise which is objectionable or irritating to vehicle occupants. For noise affecting an occupant compartment of the vehicle, a frequency of the vehicle noise may depend on the amount unoccupied or empty space in the occupant compartment. In addition, characteristics of the sound generated to cancel the vehicle noise may depend on the estimated frequency of the vehicle noise. Thus, the effectiveness of a signal generated to cancel the vehicle noise may depend on an accurate estimate of the amount unoccupied or empty space in the occupant compartment.

SUMMARY

In one aspect of the embodiments described herein, a system for actively mitigating a buffeting noise in an occupant compartment of a moving vehicle is provided. The system includes one or more processors and a memory communicably coupled to the one or more processors and storing a buffeting noise mitigation module. The buffeting noise mitigation module includes computer-readable instructions that when executed by the one or more processors cause the one or more processors to determine an estimated an effective volume of the occupant compartment, and determine if a single window of the vehicle occupant compartment is open. The buffeting noise mitigation module may also be configured to, responsive to a determination that a single window of the vehicle occupant compartment is open, and using the estimated effective volume of the occupant compartment, determine an estimated buffeting noise frequency. The buffeting noise mitigation module may also be configured to, responsive to the estimated buffeting noise frequency, determine characteristics of a sound configured to cancel a buffeting noise generated inside the occupant compartment while the vehicle is moving. The buffeting noise mitigation module may also be configured to control operation of a noise cancelling signal generating system to generate the sound having characteristics configured to cancel the buffeting noise inside the occupant compartment.

In another aspect of the embodiments described herein, a method is provided for mitigating a buffeting noise in an occupant compartment of a moving vehicle. The method includes steps of determining an estimated an effective volume of the occupant compartment and determining if a single window of the occupant compartment is open. Responsive to a determination that a single window of the occupant compartment is open, and using the estimated effective volume of the occupant compartment, an estimated buffeting noise frequency is determined. Using the estimated buffeting noise frequency, characteristics of a sound configured to cancel a buffeting noise inside the occupant compartment are determined. Operation of a noise cancelling signal generating system is then controlled to generate the sound having characteristics configured to cancel the buffeting noise inside the occupant compartment.

In another aspect of the embodiments described herein, a non-transitory computer readable medium is provided. The computer readable medium has stored therein instructions, that when executed by a computing system, cause the computing system to perform functions comprising determining an estimated an effective volume of the occupant compartment, and determining if a single window of the occupant compartment is open. Responsive to a determination that a single window of the occupant compartment is open, and using the estimated effective volume of the occupant compartment, an estimated buffeting noise frequency is determined. Using the estimated buffeting noise frequency, characteristics of a sound configured to cancel a buffeting noise inside the occupant are determined. Operation of a noise cancelling signal generating system is then controlled to generate the sound having characteristics configured to cancel the buffeting noise inside the occupant compartment.

BRIEF DESCRIPTION OF THE DRAWINGS

The accompanying drawings, which are incorporated in and constitute a part of the specification, illustrate various systems, methods, and other embodiments of the disclosure. It will be appreciated that the illustrated element boundaries (e.g., boxes, groups of boxes, or other shapes) in the figures represent one embodiment of the boundaries. In some embodiments, one element may be designed as multiple elements or multiple elements may be designed as one element. In some embodiments, an element shown as an internal component of another element may be implemented as an external component and vice versa. Furthermore, elements may not be drawn to scale.

DETAILED DESCRIPTION

Embodiments described herein relate to a system for actively mitigating a buffeting noise in an occupant compartment of a vehicle when the vehicle is moving. The system may determine an estimated effective volume of the occupant compartment, and may also determine if a single window of the vehicle occupant compartment is open. Responsive to a determination that a single window of the vehicle occupant compartment is open, and using the estimated effective volume of the occupant compartment, the system may determine an estimated buffeting noise frequency. Responsive to the estimated buffeting noise frequency, the system may determine characteristics of a sound configured to cancel a buffeting noise generated inside the occupant compartment while the vehicle is moving. The system may then control operation of a noise cancelling signal generating system to generate the sound having characteristics configured to cancel the buffeting noise inside the occupant compartment. The estimated occupant compartment effective volume and other parameters affecting the buffeting noise frequency may be continuously or periodically updated, thereby enabling the characteristics of an associated noise canceling sound to be revised as needed to effectively cancel the noise.

Figure 1:
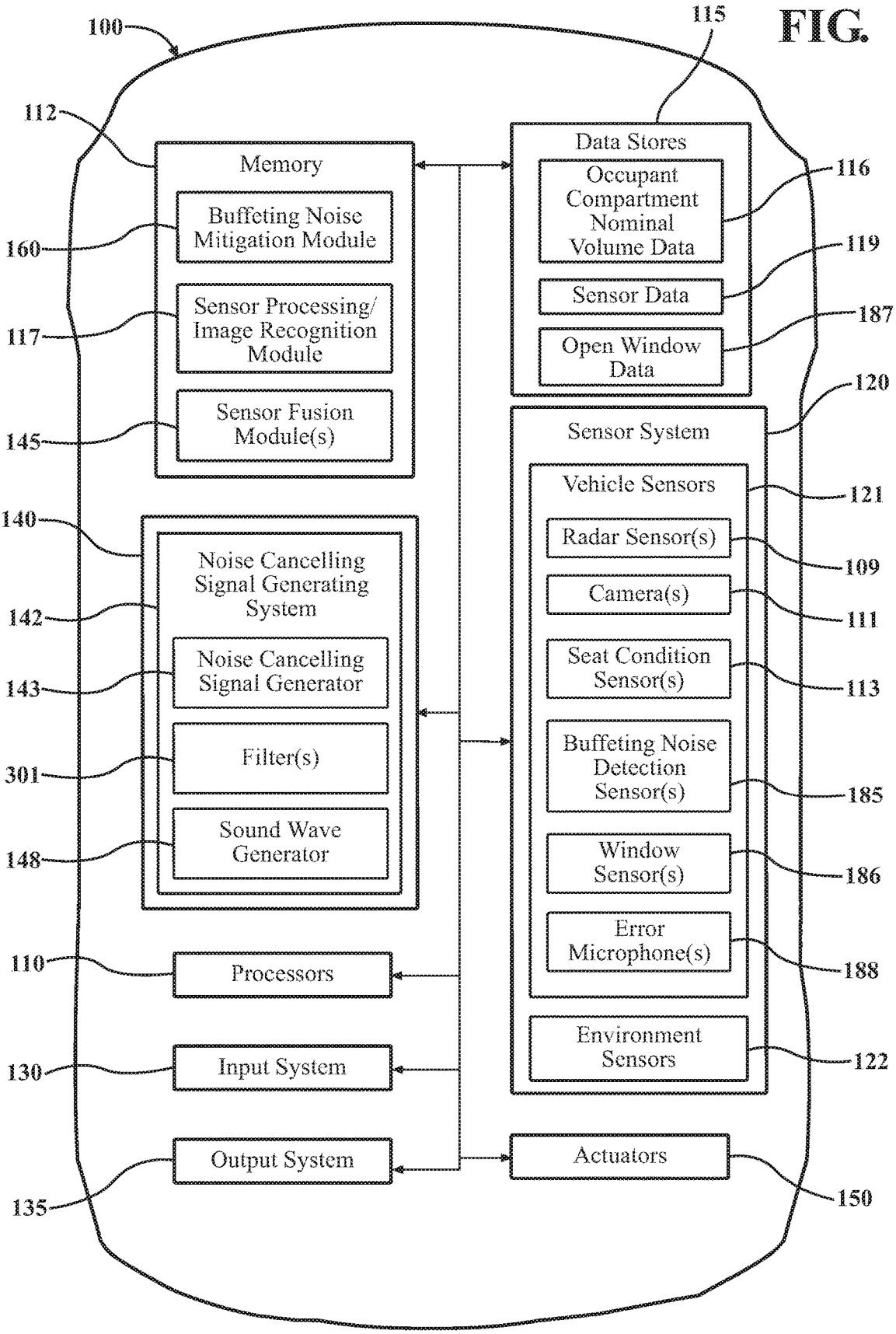
FIG. 1 is a block schematic diagram illustrating a vehicle incorporating a system for actively mitigating a buffeting noise in an occupant compartment of a moving vehicle in accordance with embodiments described herein.

Referring to FIG. 1, an example of a vehicle 100 is illustrated. As used herein, a "vehicle" is any form of motorized transport. In one or more implementations, the vehicle 100 is conventionally-powered or hybrid passenger vehicle. While arrangements will be described herein with respect to passenger vehicles, it will be understood that embodiments are not limited to passenger vehicles. In some implementations, the vehicle 100 may be any form of motorized transport that benefits from the functionality discussed herein.

The vehicle 100 also includes various elements. It will be understood that in various embodiments it may not be necessary for the vehicle 100 to have all of the elements shown in FIG. 1. The vehicle 100 can have any combination of the various elements shown in FIG. 1. Further, the vehicle 100 can have additional elements to those shown in FIG. 1. In some arrangements, the vehicle 100 may be implemented without one or more of the elements shown in FIG. 1. While the various elements are shown as being located within the vehicle 100 in FIG. 1, it will be understood that one or more of these elements can be located external to the vehicle 100.

Some of the possible elements of the vehicle 100 are shown in FIG. 1 and will be described with reference thereto. Additionally, it will be appreciated that for simplicity and clarity of illustration, where appropriate, reference numerals may have been repeated among the different figures to indicate corresponding or analogous elements. In addition, the discussion outlines numerous specific details to provide a thorough understanding of the embodiments described herein. Those of skill in the art, however, will understand that the embodiments described herein may be practiced using various combinations of these elements.

FIG. 1 shows a block schematic diagram of a vehicle 100 incorporating a system for actively mitigating a buffeting noise in an occupant compartment of a moving vehicle, in accordance with embodiments described herein. In some instances, the vehicle 100 may be configured to switch selectively between an autonomous mode, one or more semi-autonomous operational modes, and/or a manual mode. Such switching can be implemented in a suitable manner, now known or later developed. "Manual mode" means that all of or a majority of the navigation and/or maneuvering of the vehicle is performed according to inputs received from an operator (e.g., human driver). In one or more arrangements, the vehicle 100 can be a conventional vehicle that is configured to operate in only a manual mode.

In one or more embodiments, the vehicle 100 is an autonomous vehicle. As used herein, "autonomous vehicle" refers to a vehicle that can operate in an autonomous mode. "Autonomous mode" refers to navigating and/or maneuvering the vehicle 100 along a travel route using one or more computing systems to control the vehicle 100 with minimal or no input from a human driver. In one or more embodiments, the vehicle 100 is highly automated or completely automated. In one or more arrangements, the vehicle 100 is configured with one or more semi-autonomous operational modes in which one or more computing systems perform a portion of the navigation and/or maneuvering of the vehicle along a travel route, and a vehicle operator (i.e., driver) provides inputs to the vehicle to perform a portion of the navigation and/or maneuvering of the vehicle 100 along the travel route.

Figure 2A:
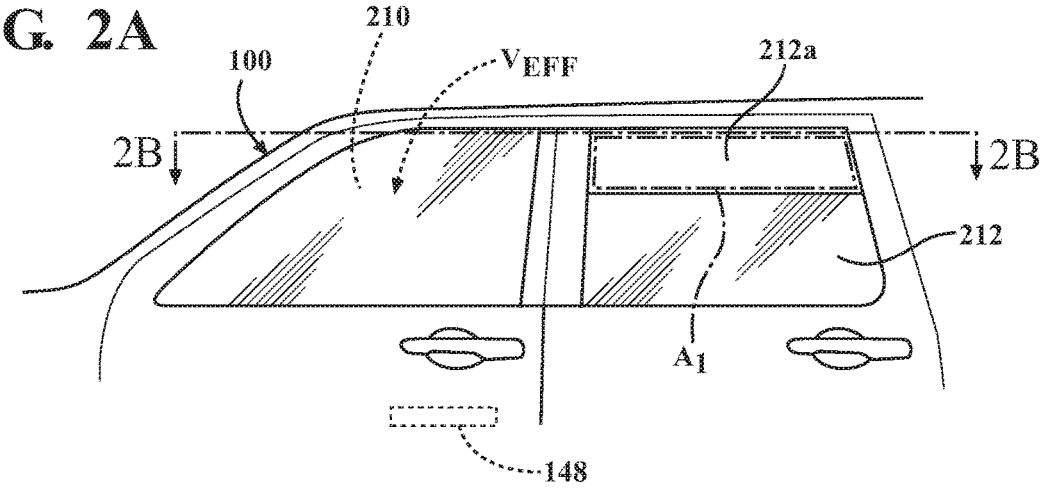
FIG. 2A is a schematic side view of a portion of the vehicle of FIG. 1 with a side window of the vehicle in a partially open condition, and illustrating an area of the open portion of the window.
Figure 2B:
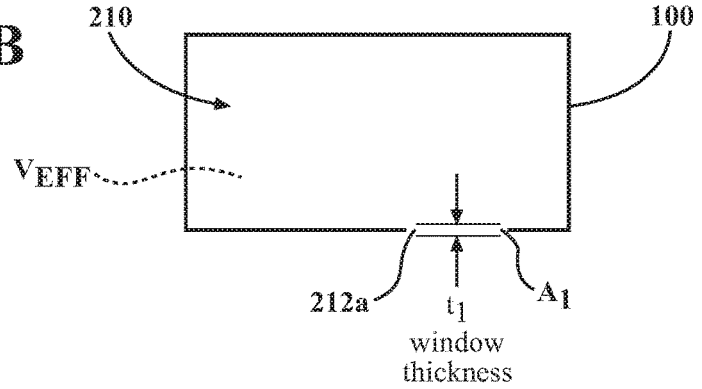
FIG. 2B is a schematic plan cross-sectional view of the vehicle occupant compartment in FIG. 2A showing the side window in the open condition, a schematic representation of an effective volume of the occupant compartment, and a thickness of the open window.

Referring to FIGS. 2A and 2B, the vehicle 100 may have an occupant compartment 210. The occupant compartment 210 may comprise an enclosure inside the vehicle 100 where living vehicle occupants (i.e., people and pets) reside while the vehicle is moving. The occupant compartment may also be used for transporting packages (e.g., groceries) and other objects.

The occupant compartment 210 may have a nominal volume $V_{NOM}$. In one or more arrangements, the nominal volume may be a total volume of empty space in the occupant compartment when the vehicle 100 is in an "as purchased from dealer" condition (i.e., without any occupants, pets, or other living and/or non-living objects which may be positioned in the occupant compartment by an owner or other operator of the vehicle during ownership and/or use of the vehicle) and with all windows and the sunroof (if any) closed.

In one or more arrangements, the vehicle seats in the occupant compartment 210 may be rearranged in a conventional passenger transport configuration to meet particular needs of an operator. The various seat rearrangements may affect the nominal volume $V_{NOM}$ of the occupant compartment for the purposes described herein. For example, a conventional passenger vehicle seat arrangement may have a driver seat, a front passenger seat, and a continuous rear seat arrangement configured for accommodating two or more rear seat passengers. In certain vehicle designs, the rear seat back may be folded forward to enable access to the vehicle trunk or a hatchback, thereby increasing the space in the rear available for transporting various items and effectively making the trunk or hatch space a portion of the occupant compartment. The rear seat back may be folded forward onto the rear seat bottom. This reconfiguration may increase the nominal volume $V_{NOM}$ of the occupant compartment. In another example, the vehicle may have individually manipulable seats, and any seat may be removed. If the vehicle is an autonomous vehicle and is to be driven fully autonomously, even the driver seat may be removed. Removal of vehicle seats may increase the nominal volume $V_{NOM}$ of the occupant compartment 210. Similarly, adding a seat may decrease the nominal volume $V_{NOM}$ of the occupant compartment. In addition, other elements designed to be located in the occupant compartment as options or as standard equipment in a new and "as purchased from dealer" condition of the particular vehicle (for example, factory child seats, removable display screens, etc.) may be removed, added, and/or reconfigured so as to affect the nominal volume $V_{NOM}$ of the occupant compartment 210. Thus, the vehicle 100 may have a first, second, third, or more nominal volumes depending on how an operator chooses to configure the vehicle interior according to available options. The nominal volume $V_{NOM}$ of the occupant compartment in various configurations may be determined prior to use of the vehicle using sensor data and stored in a memory (such as data stores 115) for the purposes described herein.

Certain vehicle sensors may be configured to detect predetermined variations of the occupant compartment configuration. For example, seat condition sensors 113 and/or other sensors may be configured to detect the presence or absence of a vehicle seat, whether a seat back is folded forward or raised, a degree to which the seat back is folded, and the presence and absence of other items which are optional and/or removable from the occupant compartment and offered with the vehicle as purchased. A number of predetermined possible variations in occupant compartment configuration in the "new and as purchased" condition of the vehicle may be associated with a corresponding predetermined estimated nominal volume and stored in a memory, in a lookup table, for example. This enables nominal volumes for a wide variety of predetermined occupant compartment configurations to be compiled and stored by the vehicle manufacturer prior to vehicle sale, for use by an embodiment of the buffeting noise mitigation system described herein.

In one or more particular arrangements, vehicle sensors as described herein may also be configured to scan the current configuration of the occupant compartment from various perspectives. Sensor data thus acquired may be processed to generate an estimate of the nominal volume $V_{NOM}$.

For purposes described herein, an "added volume" $V_{ADDED}$ may be a total volume of any objects introduced into an otherwise empty occupant compartment (i.e., when the occupant compartment is in the new and "as purchased from dealer" condition). Such objects may include people, pets, packages, and/or any other objects which occupy space inside the occupant compartment. In a manner described herein, $V_{ADDED}$ may be estimated using sensor data. Such objects may be constantly added and/or removed from the vehicle during ownership and use of the vehicle.

An "effective volume" $V_{EFF}$ of the occupant compartment 210 may be the nominal volume $V_{NOM}$ of the occupant compartment in a particular configuration, minus the estimated added volume $V_{ADDED}$ (i.e., $V_{EFF}=V_{NOM}-V_{ADDED}$). As described herein, vehicle sensors may acquire data usable for estimating the effective volume $V_{EFF}$ of the occupant compartment when living occupants, packages, etc. are positioned in the compartment.

The nominal volume $V_{NOM}$ of the occupant compartment may be dynamically updated using sensor data as the configuration of the occupant compartment is changed, for example, by removing a seat or folding down a rear seat back. Similarly, the values of the effective volume $V_{EFF}$ and added volume $V_{ADDED}$ may be estimated before or during each use of the vehicle 100 before the vehicle starts moving, and may be dynamically updated using sensor data as objects are added to or removed from the occupant compartment during vehicle use. In one or more arrangements, the vehicle sensors directed to detecting changes in the effective volume $V_{EFF}$ may be configured to dynamically detect the volume changes during vehicle use and while the vehicle is moving. For example, vehicle sensors (such as cameras 111 and/or radar sensors 109 described herein) may be configured to detect changes in the effective volume $V_{EFF}$ due to a vehicle occupant positioning his/her head and/or arms outside a partially open window (and therefore outside the occupant compartment 210) when then vehicle is moving. Changes in effective volume $V_{EFF}$ due to objects being ejected from the occupant compartment while the vehicle is moving may also be detected. Estimates of canceling sound generation control parameters such as f1 as described herein may also be dynamically revised based on these detected changes in effective volume $V_{EFF}$.

FIGS. 2A-2B are schematic views of portions of a vehicle 100 illustrating parameters used in estimating a frequency f1 of a buffeting noise which may be generated inside the occupant compartment 210 when the vehicle is moving with a single window open. FIG. 2A is a schematic side view of a portion of the vehicle 100 with a side window 212 in a partially open condition. FIG. 2A shows an area $A_1$ of the open portion 212*a* of the window 212. FIG. 2B is a schematic plan cross-sectional view of a vehicle occupant compartment 210 in FIG. 2A showing the open portion 212*a* of the side window 212, a schematic representation of an effective volume $V_{EFF}$ of the occupant compartment, and a thickness $t_1$ of the window 212 which is used to estimate an effective neck length $L_{EFF}$ of the open window 212.

Referring to FIGS. 2A and 2B, in embodiments described herein, the vehicle occupant compartment 210 may be assumed to function as a Helmholtz resonator with an effective volume of $V_{EFF}$. The effective volume $V_{EFF}$ may be used to estimate a frequency $f_1$ of a buffeting noise which may be generated inside the occupant compartment 210 when the vehicle is moving with a single window (including a side window or a sunroof) open. The frequency $f_1$ of the buffeting noise may be estimated using the relationship:

$$f_1 = \frac{1}{2\pi}\sqrt{\frac{A_1}{V_{EFF}L_{EFF}}} \tag{1}$$

where $A_1$ is an area of the opening defined by the open window and $L_{EFF}$ is an effective neck length which may be estimated based on the window thickness $t_1$ and the amount the window has been opened, using the following relationship:

$$L_{EFF}=t_1+\alpha\sqrt{A_1} \tag{2}$$

where $t_1 \ll \alpha\sqrt{A_1}$ and $\alpha$ is a correction factor in the range of 0.95-0.98 which depends on the shape of the area $A_1$ of the open portion of the window.

The frequency $f_1$ of the buffeting noise may be used to determine characteristics of a sound configured to cancel the buffeting noise inside a moving vehicle. For example, the noise cancelling sound determined using frequency $f_1$ may be generated and output as an active noise canceling output by a sub-woofer or other speaker. In one or more arrangements, the canceling sound may have the frequency $f_1$ and be equal in amplitude but opposite in phase to the buffeting noise.

Referring again to FIG. 1, the vehicle 100 can include one or more processors 110. In one or more arrangements, the processor(s) 110 can be a main processor(s) of the vehicle 100. For instance, the processor(s) 110 can be an electronic control unit (ECU). The vehicle 100 can include one or more data stores 115 for storing one or more types of data. The data store(s) 115 can include volatile and/or non-volatile memory. Examples of suitable data store(s) 115 include RAM (Random Access Memory), flash memory, ROM (Read Only Memory), PROM (Programmable Read-Only Memory), EPROM (Erasable Programmable Read-Only Memory), EEPROM (Electrically Erasable Programmable Read-Only Memory), registers, magnetic disks, optical disks, hard drives, or any other suitable storage medium, or any combination thereof. The data store(s) 115 can be a component of the processor(s) 110, or the data store(s) 115 can be operably connected to the processor(s) 110 for use thereby. The term "operably connected," as used throughout this description, can include direct or indirect connections, including connections without direct physical contact.

The one or more data store(s) 115 can include open window data 187. The open window data 187 can include lookup tables, equations, and/or other functions and elements relating an amount that a vehicle window or sunroof is open to an area $A_1$ of the open portion of the window or sunroof.

The one or more data store(s) 115 can include occupant compartment nominal volume data 116. The occupant compartment nominal volume data 116 may include the nominal volume of the occupant compartment in the "as purchased from dealer" condition. The occupant compartment nominal volume data 116 may also include nominal volumes of the occupant compartment in a variety of predetermined conditions (for example, with various vehicle seats reconfigured and/or removed) as previously described. The one or more data store(s) 115 can also include stored latest or current values of parameters such as f1, $A_1$, $V_{EFF}$, $L_{EFF}$ and other parameters and information as determined from the latest sensor data.

The one or more data store(s) 115 can include sensor data 119. In this context, "sensor data" means any information about the sensors that the vehicle 100 is equipped with, including the capabilities and other information about such sensors. As will be explained below, the vehicle 100 can include the sensor system 120. The sensor data 119 can relate to one or more sensors of the sensor system 120. As an example, in one or more arrangements, the sensor data 119 can include information on one or more cameras 111 of the sensor system 120.

As noted above, the vehicle 100 can include the sensor system 120. The sensor system 120 can include one or more sensors. "Sensor" means any device, component and/or system that can detect, and/or sense something. The one or more sensors can be configured to detect, and/or sense in real-time. As used herein, the term "real-time" means a level of processing responsiveness that an operator or system senses as sufficiently immediate for a particular process or determination to be made, or that enables the processor to keep up with some external process.

In arrangements in which the sensor system 120 includes a plurality of sensors, the sensors can work independently from each other. Alternatively, two or more of the sensors can work in combination with each other. In such case, the two or more sensors can form a sensor network. The sensor system 120 and/or the one or more sensors can be operably connected to the processor(s) 110, the data store(s) 115, and/or another element of the vehicle 100 (including any of the elements shown in FIG. 1). The sensor system can acquire data describing a state of the vehicle occupant compartment 210, such as the number, positions and volumes of occupants and other objects and other data described herein. The sensor system 120 can also acquire data of at least a portion of the external environment of the vehicle 100 (e.g., nearby objects).

The sensor system 120 can include any suitable type of sensor. Various examples of different types of sensors will be described herein. However, it will be understood that the embodiments are not limited to the particular sensors described. Various examples of sensors of the sensor system 120 are described herein. The example sensors may be part of the one or more environment sensors 122 and/or the one or more vehicle sensors 121. However, it will be understood that the embodiments are not limited to the particular sensors described. The sensor system 120 may include any sensors suitable for and/or required to perform any of the data acquisition and/or vehicle control operations contemplated herein.

Sensors of sensor system 120 may be communicably coupled to the various systems and components of the vehicle 100. The sensors may be operably connected to vehicle systems and components, such as data stores 115, processor(s) 110, and sensor processing/image recognition module 117 for storage and processing of vehicle and environmental sensor data. Sensor system 120 may include sensors configured to detect and generate indications of the current state or status of vehicle systems and components.

The sensor system 120 can include one or more vehicle sensors 121. The vehicle sensor(s) 121 can detect, determine, and/or sense information about the vehicle 100 itself and/or any occupants and/or other objects inside the vehicle occupant compartment 210.

The vehicle sensor(s) 121 may include sensors configured to detect conditions and/or events inside the vehicle interior or occupant compartment. For example, radar sensor(s) 109 may be employed to detect the presence of living objects (e.g., people, pets) and non-living objects inside the vehicle occupant compartment. The radar sensor(s) 109 may be configured to scan the vehicle occupant compartment 210 and distinguish between separate objects present therein. In one approach, the radar sensor(s) 109 may use initial baseline scans taken when the occupant compartment is in the empty or "as purchased from dealer" condition as a basis of comparison against later scans, to aid the sensors in detecting separate, added objects and distinguishing the empty condition of the occupant compartment from an "occupied" condition. In further approaches, the radar sensor(s) 109 and/or a computing system operably connected thereto may implement a complex analysis of the radar sensor data, such as using a machine learning algorithm to analyze the radar data, detect/classify separate objects, and estimate the volumes of the added objects.

The radar sensor(s) 109 may be configured to distinguish between living objects and inanimate objects. For example, the radar sensor(s) may be capable of detecting movements of an occupant's chest during respiration. The radar sensor(s) 109 may be configured to distinguish features such as the locations and dimensions (including volumes) of individual occupants.

In one or more arrangements, the radar sensor(s) 109 may be one or more ultra-wide band (UWB) radar sensors. It has been found that UWB radar is especially effective in detecting living objects in the occupant compartment, and also in distinguishing living objects from inanimate objects. This technology can also distinguish location, size, and further attributes of the vehicle occupants. Data from the radar sensors may also be processed to provide the volumes of animate and inanimate objects in the field of view of the sensor(s).

In one or more configurations described herein, the UWB radar sensor may be an ultra-wideband radar operating in the frequency spectrum between 60 GHz and 79 GHz. In particular configurations, the sensor(s) may operate as an imaging radar at a frequency at or around 60 GHz for purposes of scanning the vehicle occupant compartment. A single sweep of the radar scanner may scan the entire portion of the vehicle occupant compartment detectable in the field of vision of the radar sensor. A single sweep of the sensor and associated processing may produce a single frame of data. In one or more configurations, the radar sensor may operate at about 5 frames/per second (i.e., 5 sweeps per second). Operating under these parameters, it is desirable to acquire data for a period of 5-10 seconds to facilitate removal of anomalies from the data and provide a clear image. Thus, a "scan" may comprise enough sweeps to provide sufficient data to facilitate removal of anomalies from the data and provide a clear image.

Vehicle sensors may include camera(s) 111 configured to acquire image information relating to objects in the occupant compartment. The cameras may incorporate (or be in operable communication with) image processing and/or recognition routines configured to distinguish between separate objects and estimate (or aid in estimating) the volume of each separate object. In one or more arrangements, camera data may be forwarded to a sensor processing/image recognition module 117 for further analysis and estimation of object volumes. For example, analysis of camera image data may be employed to detect the presence of living objects (e.g., people, pets) and non-living objects inside the vehicle occupant compartment. Analysis of camera image data relating to the occupant compartment may be used to distinguish between separate objects present therein and to estimate (or aid in estimating) characteristics (such as volumes) of objects and features in the occupant compartment.

The cameras 111 may also use initial baseline scans taken when the occupant compartment is in the empty or "as purchased from dealer" condition as a basis of comparison against later scans, to aid the sensors in detecting separate, added objects and distinguishing the empty condition of the occupant compartment from an "occupied" condition. In further approaches, the cameras 111 and/or a computing system operably connected thereto may implement a complex analysis of the camera image data such as using a machine learning algorithm to analyze the camera image data, detect/classify separate objects, and estimate the volumes of the added objects.

One or more of the vehicle sensors 121 (including radar sensors, cameras, and/or other vehicle sensors) may be configured and positioned to detect objects positioned in any portion of the vehicle which was empty or unoccupied by an object when the vehicle was in an "as purchased from dealer" condition. The sensors may be configured and positioned to scan and detect objects positioned on the floors of the vehicle, in the area behind the rear passenger seats, in a hatch or trunk of the vehicle (in case the rear seat back is folded forward), on the dashboard, attached to or suspended from the ceiling, and/or in any other spaces in which objects may be positioned intentionally or inadvertently, depending on the design of the particular vehicle. The sensors may be configured to estimate the volumes of the objects detected, or sensor data may be forwarded to the sensor processing/image recognition module 117 for further analysis and estimation of object volumes.

Window sensors 186 may detect open and closed conditions of each vehicle window, and may also detect the amount or degree to which each window is open. An estimate of an open area $A_1$ of an open vehicle side window or the sunroof (if any) for each degree to which the window/sunroof may be opened can be compiled and stored in a memory, for example, in the form of a lookup table or as one or more formulae in open window data 187. These values of open window area may be used as described herein to estimate the frequency f1 of a buffeting noise that is occurring (or would occur) in a Helmholtz resonator with an effective volume of $V_{EFF}$.

Seat condition sensors 113 may be configured to detect the presence/absence of vehicle seats, the conditions (folded/lowered or raised) of the seat backs, and the degrees to which folded seat backs are folded. Data from the seat condition sensors 113 may be used to adjust the estimated value of the nominal volume $V_{NOM}$ of the occupant compartment. For example, if a seat is removed, a predetermined estimated value of the nominal volume associated with the occupant compartment with the seat removed may be accessed from memory and used by the buffeting noise mitigation system for estimating the effective volume $V_{EFF}$.

The vehicle sensors 121 may include one or more buffeting noise detection sensors 185. The buffeting noise detection sensor(s) 185 may be positioned within the occupant compartment 210 and configured to detect and transmit sensor data indicative of a buffeting noise. The buffeting noise can be caused by the opening of one of the side windows or a sun roof when the vehicle 100 is in motion. A buffeting noise may be defined as a low frequency sound wave or low frequency throbbing sound in the occupant compartment. In one or more conditions, the low frequency throbbing may be sound pressure in a frequency below about thirty hertz and, more particularly, between about eight and about twenty Hertz. The buffeting noise detection sensor(s) 185 may be configured to detect a low frequency sound wave or low frequency throbbing sound in one or more of these ranges. The buffeting noise detection sensor(s) 185 may also (or alternatively) be configured to detect sounds in other frequency ranges. The sensor(s) 185 may be configured to detect only sounds in one or more of the specified frequency range(s) above, or the sensor(s) 185 may be configured to detect sounds in a wide variety of frequency ranges and to forward all detected sounds to the sensor processing/image recognition module 117 for frequency discrimination/determination and further analysis.

The sensor(s) 185 may be any type of sensor that is capable of detecting sound or pressure changes within the vehicle occupant compartment 210. In one or more arrangements, the one or more sensors 185 are pressure transducers or microphones capable of detecting sound waves within the occupant compartment. In alternate embodiments, the sensor(s) are a combination of different types of sensors positioned within the occupant compartment. The position(s) of the sensor(s) 185 in the occupant compartment may vary depending upon the type of sensor being used. However, it is desirable to position the sensor(s) 185 at location(s) that will allow for quick and early detection of the buffeting noise in the occupant compartment 210.

In addition, the sensor system 120 can include one or more environment sensors 122 configured to acquire, and/or sense driving environment data. "Driving environment data" includes data or information about the external environment in which the vehicle is located or one or more portions thereof. For example, the one or more environment sensors 122 can be configured to detect, quantify and/or sense obstacles in at least a portion of the external environment of the vehicle 100 and/or information/data about such obstacles. Such obstacles may be stationary objects and/or dynamic objects. As examples, in one or more arrangements, the environment sensors 122 can include one or more radar sensors, one or more LIDAR sensors, one or more sonar sensors, and/or one or more cameras (not shown).

The vehicle 100 can include an input system 130. An "input system" includes any device, component, system, element or arrangement or groups thereof that enable information/data to be entered into a machine. For example, the input system 130 may include a keypad, a touch screen or other interactive display, a voice-recognition system and/or any other device or system which facilitates communications between an operator and the vehicle 100. The input system 130 can receive an input from a vehicle occupant (e.g., a driver or a passenger) or an operator located remotely from the vehicle 100.

Figure 4:
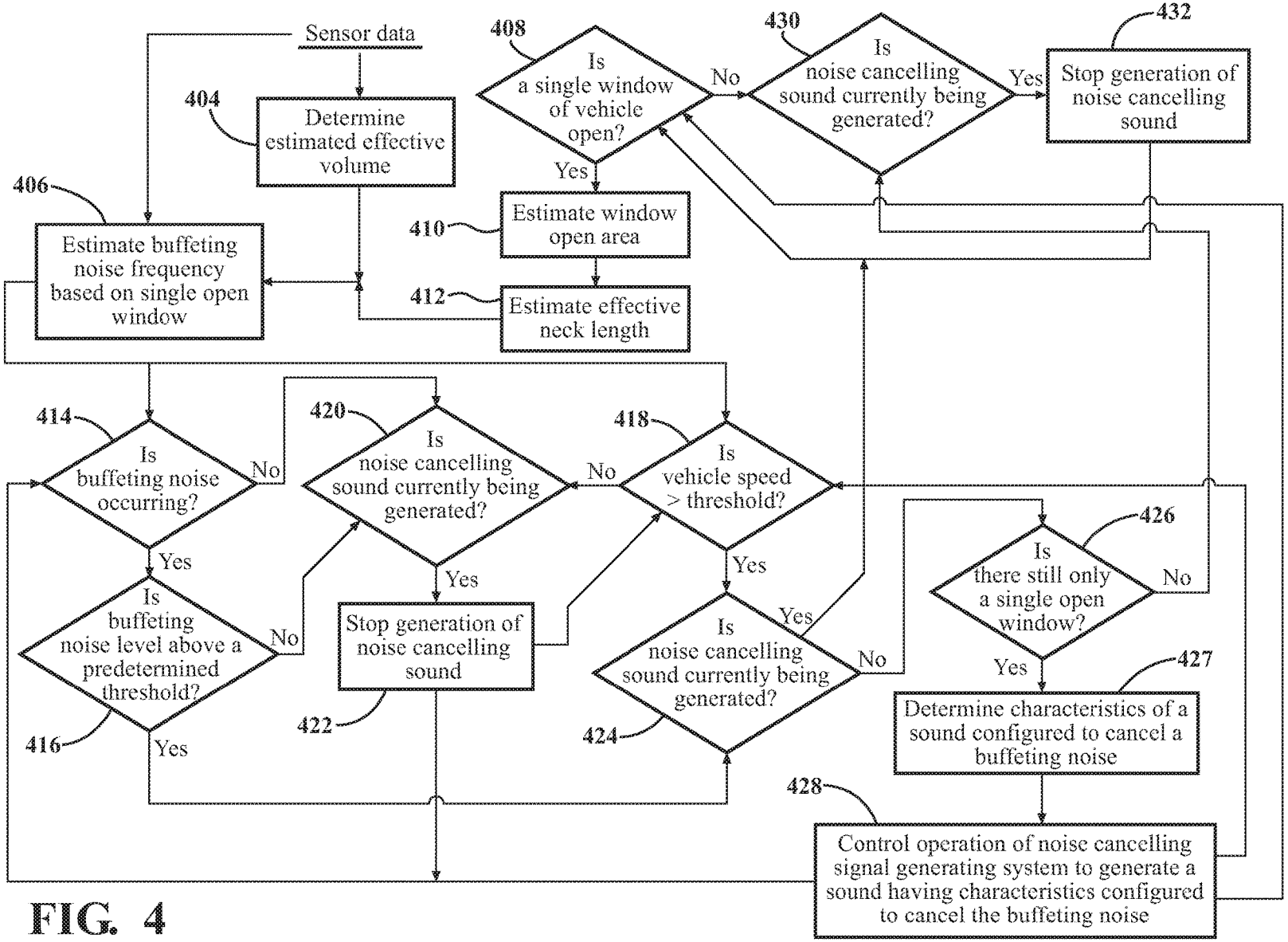
FIG. 4 is a flow diagram illustrating operation of a system for actively mitigating a buffeting noise in an occupant compartment of a moving vehicle in accordance with an embodiment described herein.

In one or more arrangements, the input system may be configured to enable a vehicle operator to specify one or more operating conditions of a system for actively mitigating a buffeting noise as described herein. For example, as shown in FIG. 4 and as described in greater detail below, the operator may specify that the system will autonomously operate in a first operational mode to generate a noise canceling signal if a single window of the vehicle is open, a buffeting noise is detected in the occupant compartment by the buffeting noise detection sensors 185, and a level of the noise is above a predetermined sound level threshold (i.e., control may proceed from blocks 404 and 408/410/412 to block 406 and then to block 414, bypassing block 418). Alternatively, as shown in FIG. 4, the operator may specify that the system will autonomously operate in a second operational mode to generate a noise canceling signal if a single window of the vehicle is open and the vehicle is moving at a speed above predetermined speed threshold (i.e., control may proceed from blocks 404 and 408/410/412 to block 406 and then to block 418, bypassing block 414). In one or more other arrangements, the operator may specify that the system will autonomously operate to generate a noise canceling signal if the conditions specified in either of the first or second operational modes occur.

The vehicle 100 can also include an output system 135. An "output system" includes any device, component, or arrangement or groups thereof that enable information/data to be presented to a vehicle occupant (e.g., a driver, a vehicle passenger, etc.) or a remote operator.

The vehicle 100 can include one or more actuators 150. The actuators 150 can be any element or combination of elements operable to modify, adjust and/or alter one or more of the vehicle systems or components thereof to responsive to receiving signals or other inputs from the processor(s) 110 and/or the buffeting noise mitigation module 160. Any suitable actuator can be used. For instance, the one or more actuators 150 can include motors, pneumatic actuators, hydraulic pistons, relays, solenoids, and/or piezoelectric actuators, just to name a few possibilities.

The vehicle 100 can include one or more vehicle systems, collectively designated 140. Various examples of the one or more vehicle systems 140 can include a propulsion system, a braking system, a steering system, throttle system, a suspension system, a transmission system, a climate control system, and/or a navigation system, none of which are shown in FIG. 1. FIG. 1 shows a noise canceling signal generating system 142 included in the vehicle systems 140. Each of these systems can include one or more devices, components, and/or a combination thereof, now known or later developed. It should be appreciated that each or any of the vehicle systems or portions thereof may be combined or segregated via hardware and/or software within the vehicle 100.

The vehicle systems 140 can include the noise cancelling signal generating system 142. The noise cancelling signal generating system 142 may be operable to generate a sound configured to cancel a buffeting noise which may occur inside the occupant compartment. The noise cancelling signal generating system 142 can include any elements and/or subsystems (in the form of hardware and/or software) which facilitate or enable performance of the noise cancelling signal determination and/or generation functions described herein. The noise cancelling signal generating system 142 may be configured to generate a noise-canceling sound designed to cancel or at least substantially mitigate a buffeting noise which may be produced in the vehicle occupant compartment 210 when a single window (or a sunroof) of the vehicle is at least partially open and the vehicle is moving.

Figure 3:
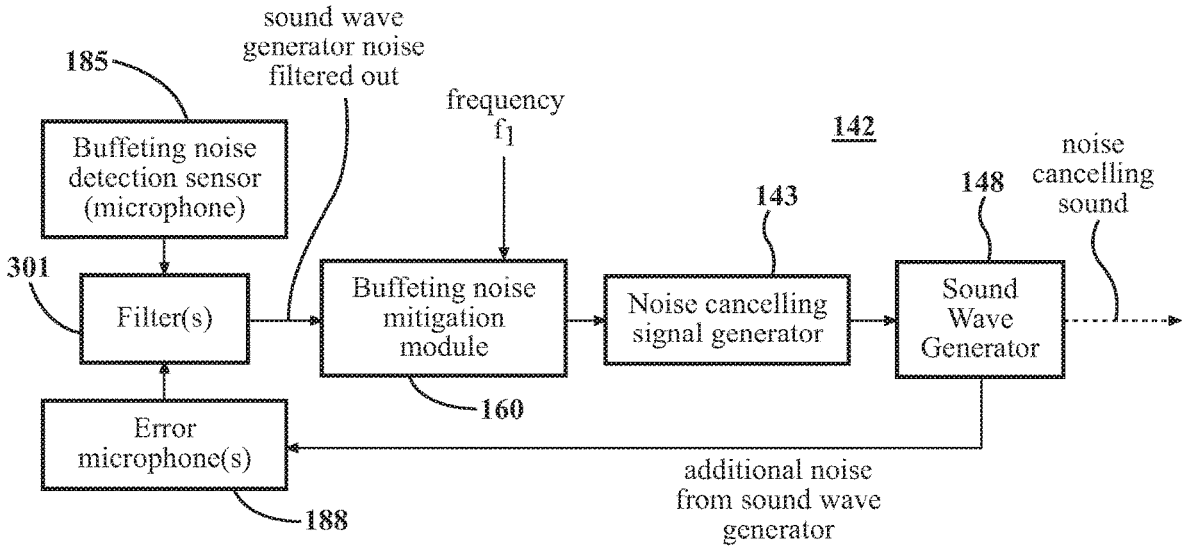
FIG. 3 is a block schematic diagram illustrating operation of a particular arrangement of a noise cancelling signal generating system described herein.

The noise cancelling signal generating system 142 may include a noise canceling signal generator 143. The signal generator 143 may be configured to generate a signal for controlling operation of a sub-woofer, speaker, or other type of sound wave generator 148 to produce a sound having characteristics configured to cancel or mitigate a buffeting noise generated inside the occupant compartment 210 while the vehicle 100 is moving. The signal generator may be configured to generate the control signal using the buffeting noise frequency f1 and/or other sensor data, including data from buffeting noise detection microphones 185 and error microphones 188 (FIG. 3).

The noise cancelling signal generating system 142 may include one or more sound wave generators 148. In one or more arrangements, the one or more sound wave generator(s) 148 may be in the form of sub-woofers or other speakers. Sound wave generator(s) 148 may be configured to generate a noise canceling sound responsive to a control signal received from the signal generator 143 (i.e., the sound wave generator(s) 148 may convert the control signal into a sound having characteristics configured to cancel a buffeting noise). In one or more arrangements, sound wave generator(s) 148 in the form of sub-woofers or other speakers may be standard production components of a vehicle stereo system which may be operated to produce the noise-canceling signal under conditions described herein.

While the sound wave generators 148 may be described herein in the form of sub-woofers of other types of speakers, the signal generating system 142 may incorporate any type of sound wave generator capable of generating sound waves having the characteristics required of the canceling signal. Suitable sound wave generators include but are not limited to automobile speakers and/or subwoofers, piezoelectric sound generators or piezoelectric speakers and air pressure generators.

In one or more arrangements, as described herein, the noise cancelling signal generating system 142 may be controllable by a buffeting noise mitigation module 160 (described in greater detail below) to generate a noise canceling signal if either one of two modes or sets of conditions occur. In a first mode, the buffeting noise mitigation module 160 may control the signal generating system 142 to generate a noise canceling signal when a single window of the vehicle 100 is open and a buffeting noise is detected by buffeting noise detection sensors 185 as actually occurring in the occupant compartment. In a second mode, the buffeting noise mitigation module 160 may control the signal generating system 142 to generate a noise canceling sound when a single window of the vehicle 100 is open and the vehicle is traveling at a speed above a predetermined threshold speed.

The noise cancelling signal may be a sound having characteristics configured to cancel a buffeting noise generated inside the occupant compartment 210 while the vehicle is moving. Characteristics of the noise-canceling sound to be generated by the signal generating system 142 may be determined by the buffeting noise mitigation module 160 responsive to sensor data as described herein. In one or more arrangements, the noise cancelling signal may be equal in amplitude but opposite in phase from the buffeting noise.

FIG. 3 illustrates operation of an aspect of one or more particular arrangements of the noise cancelling signal generating system 142 in which the vehicle sensors 121 include at least one buffeting noise detection sensor(s) 185 in the form of at least one microphone configured to detect when a buffeting noise is occurring, and at least one error microphone 188 configured to detect noise generated by a sub-woofer/speaker or other sound wave generator 148 used to generate the noise canceling sound. The noise cancelling signal generating system 142 may be operable as described herein under direction of the buffeting noise mitigation module 160 or under direction of a dedicated signal generating system controller (not shown) controlled by the buffeting noise mitigation module 160.

Referring to FIG. 3, a buffeting noise detection sensor(s) 185 in the form of at least one microphone may detect the occurrence of a buffeting noise when only one vehicle window (including a sunroof) is open. The buffeting noise may be passed to one or more filters 301 as a reference signal to aid the filter(s) in distinguishing the buffeting noise from additional noise produced by the sound wave generator 148 when generating the canceling sound. The error microphones 188 may also detect the additional noise from the noise cancelling sound output by the sound wave generator 148. This additional noise may be forwarded to the filter(s) 301.

The filtered signal (with the sound wave generator noise removed or attenuated) may be passed to the buffeting noise mitigation module 160. Then, using the estimated buffeting noise frequency f1, the buffeting noise mitigation module 160 may determine characteristics of a sound configured to cancel the buffeting noise generated inside the occupant compartment 210 while the vehicle is moving. The buffeting noise mitigation module 160 may then control operation of the noise cancelling signal generator 143 to generate a signal configured for controlling the sound wave generator 148 to generate the sound having characteristics for canceling the buffeting noise inside the occupant compartment 210. Additional, extraneous sound generated by the sound wave generator 148 may also be picked up by the error microphones 188 and fed into the filter(s) 301 as previously described, to enable this sound to be distinguished and filtered out of the buffeting sound detected by sensor(s) 185. In this manner, the control loop shown in FIG. 3 provides active feedback to optimize the active noise control and allows the sub-woofer/speaker to emit an active noise canceling sound of equal in amplitude but opposite in phase to the buffeting noise.

Referring again to FIG. 1, the vehicle 100 can include one or more modules, at least some of which are described herein. The modules can be implemented as computer-readable program code that, when executed by a processor 110, implement one or more of the various processes described herein. One or more of the modules can be a component of the processor(s) 110, or one or more of the modules can be executed on and/or distributed among other processing systems to which the processor(s) 110 is operably connected. The modules can include instructions (e.g., program logic) executable by one or more processor(s) 110. Alternatively, or in addition, one or more of data store(s) 115 may contain such instructions.

Generally, a module, as used herein, includes routines, programs, objects, components, data structures, and so on that perform particular tasks or implement particular data types. In further aspects, a memory generally stores the noted modules. The memory associated with a module may be a buffer or cache embedded within a processor, a RAM, a ROM, a flash memory, or another suitable electronic storage medium. In still further aspects, a module as envisioned by the present disclosure is implemented as an application-specific integrated circuit (ASIC), a hardware component of a system on a chip (SoC), as a programmable logic array (PLA), or as another suitable hardware component that is embedded with a defined configuration set (e.g., instructions) for performing the disclosed functions.

In one or more arrangements, one or more of the modules described herein can include artificial or computational intelligence elements, e.g., neural network, fuzzy logic or other machine learning algorithms. Further, in one or more arrangements, one or more of the modules can be distributed among a plurality of the modules described herein. In one or more arrangements, two or more of the modules described herein can be combined into a single module.

The vehicle 100 can include a buffeting noise mitigation module 160. In one or more arrangements, the buffeting noise mitigation module 160 may include computer-readable instructions that when executed by the processor(s) 110 cause the processor(s) to determine an estimated an effective volume $V_{EFF}$ of the occupant compartment 210, and to determine if a single window of the vehicle occupant compartment is open. Responsive to a determination that a single window of the vehicle occupant compartment is open, and using the estimated effective volume $V_{EFF}$ of the occupant compartment 210, the buffeting noise mitigation module 160 may determine an estimated buffeting noise frequency $f_1$. Using the estimated buffeting noise frequency, the buffeting noise mitigation module 160 may determine characteristics of a sound configured to cancel a buffeting noise generated inside the occupant compartment 210 while the vehicle 100 is moving. The buffeting noise mitigation module 160 may then control operation of the noise cancelling signal generating system 142 to generate the sound having characteristics configured to cancel the buffeting noise inside the occupant compartment.

The buffeting noise mitigation module 160 may also include computer-readable instructions that when executed by the processor(s) cause the processor(s) to subsequently determine if a single window remains open in the vehicle. Responsive to a determination that a single window does not remain open, the buffeting noise mitigation module 160 may control operation of the signal generating system to stop generation of the sound configured to cancel the buffeting noise (i.e., generation of the canceling sound is stopped when an open window generating (or capable of generating) a buffeting noise is closed).

In one or more arrangements, the buffeting noise mitigation module 160 may include computer-readable instructions that when executed by the processor(s) 110 cause the processor(s) to control operation of the noise canceling signal generating system 142 to generate the sound when the vehicle 100 is traveling at a speed above a predetermined threshold. The buffeting noise mitigation module 160 may also include computer-readable instructions that when executed by the processor(s) cause the processor(s) to control operation of the signal generating system 142 to stop generation of the sound when the vehicle speed falls below the predetermined threshold. In one or more particular arrangements, the vehicle speed threshold is 20 miles/hour.

In one or more arrangements, the buffeting noise mitigation module 160 may include computer-readable instructions that when executed by the processor(s) 110 cause the processor(s) to control operation of the signal generating system 142 to generate the sound when a buffeting noise level detected within the occupant compartment 210 is above a predetermined threshold. The buffeting noise mitigation module 160 may also include computer-readable instructions that when executed by the processor(s) cause the processor(s) to control operation of the signal generating system 142 to stop generation of the sound if the buffeting noise level falls below the predetermined threshold. In one or more particular arrangements, the predetermined sound level threshold is 50 dB.

In one or more arrangements, the buffeting noise mitigation module 160 may include computer-readable instructions that when executed by the processor(s) cause the processor(s) to estimate a nominal volume $V_{NOM}$ of the occupant compartment 210 using a method described herein or another method. The buffeting noise mitigation module 160 may also be configured to estimate an added volume $V_{ADD}$ of objects residing in the occupant compartment using a method described herein or another method. The buffeting noise mitigation module may also be configured to, using the nominal volume and the added volume, estimate the effective volume $V_{EFF}$ of the occupant compartment 210 as described herein.

In one or more arrangements, the vehicle 100 can include a sensor processing/image recognition module 117. The sensor processing/image recognition module 117 may be configured to receive data from radar sensors 109, cameras 111, and other sensors, and to process and/or aid in processing the sensor data. In one or more aspects, processing of the data by the sensor processing/image recognition module 117 may aid in providing rapid and accurate estimates of the volumes of objects detected in the occupant compartment and estimates of nominal volume $V_{NOM}$.

Referring again to FIG. 1, the vehicle 100 can include a sensor fusion module 145. The sensor fusion module may store one or more sensor fusion algorithms (or may incorporate or be in communication with a computing device storing an algorithm) configured to accept data from the sensor system 120 as an input. The data may include, for example, data representing information sensed at the sensors of the sensor system 120. The sensor fusion algorithm may include or be configured to be executed using, for instance, a Kalman filter, Bayesian network, or other algorithm. The sensor fusion algorithm may provide various assessments based on the data from sensor system 120. The assessments may include estimations of the volumes of individual objects in the occupant compartment based on sensor data from radar sensors 109, cameras 111, and/or other sensors. The assessments may also include estimations of the volumes of empty or unoccupied portions of the occupant compartment from which an estimate of the nominal volume $V_{NOM}$ of the occupant compartment may be generated. Other assessments are possible.

FIG. 4 is a flow diagram illustrating operation of a system for actively mitigating a buffeting noise in an occupant compartment of a moving vehicle in accordance with an embodiment described herein. The buffeting noise mitigation system may be configured to operate as described herein whenever the vehicle 100 is moving or being propelled along a ground surface. Such movement of the vehicle may be determined in any of a variety of ways, such as vehicle inertial sensors, for example.

Referring to FIG. 4, in block 404, the buffeting noise mitigation module 160 may determine, based on received sensor data, an estimated effective volume $V_{EFF}$ of the occupant compartment 210. As described previously, the effective volume $V_{EFF}$ may be continuously or periodically updated using sensor data and based on the addition, removal, and/or reconfiguration of objects in the occupant compartment. Simultaneously, in blocks 408-412, the vehicle window sensors 186 may constantly monitor a status (i.e., open or closed) of the vehicle windows and sunroof and an amount by which the window/sunroof is open. This information may be used to estimate or calculate the values of parameters such as $A_1$, $V_{EFF}$, and $L_{EFF}$, which may be continuously updated and forwarded to the buffeting noise mitigation module 160.

In block 406, using the values of the parameters and the equation (1) previously described, the buffeting noise mitigation module 160 may estimate the frequency $f_1$ that a buffeting noise that should be produced in the current state of the occupant compartment and open window. The estimated frequency $f_1$ may also be continuously updated based on changes in the effective volume $V_{EFF}$, the window open area $A_1$, and any other pertinent parameters.

In block 414, the buffeting noise mitigation module 160 may determine if a buffeting noise is currently occurring. The occurrence of a buffeting noise may be detected by buffeting noise detection sensors 185 as previously described. If it is determined if a buffeting noise is currently occurring, the buffeting noise mitigation module 160 may (in block 416) determine if a level of the buffeting noise is above a predetermined threshold. If the level of the buffeting noise is not above the predetermined threshold, the buffeting noise mitigation module 160 may (in block 420) determine if a noise-canceling sound is currently being generated by the sound wave generator 148. If a noise-canceling sound is currently being generated while the level of the noise is less than the predetermined threshold, the buffeting noise mitigation module 160 may (in block 422) stop generation of the noise-canceling sound. This function discontinues generation of the noise-canceling sound whenever the buffeting noise sound level falls below the predetermined threshold. Control may then pass to block 414, where the buffeting noise mitigation module 160 may continue to monitor whether or not a buffeting noise is occurring.

Returning to block 416, if the buffeting noise level is above the predetermined threshold, the buffeting noise mitigation module 160 may (in block 424) determine if a noise-canceling sound is currently being generated. If a noise-canceling sound is currently not being generated with the noise level above the predetermined threshold, the buffeting noise mitigation module 160 may (in block 426) determine if there is still only a single open window. This may be determined using sensor data as previously described. If there is still only a single open window, the buffeting noise mitigation module 160 may (in block 427, and using the estimated frequency f1 and any other pertinent information) determine characteristics of a sound configured to cancel a buffeting noise.

In one or more instances, the sound may be configured to cancel an existing buffeting noise detected by the buffeting noise detection sensors 185. In another instance, the sound may be configured to cancel a buffeting noise that may occur due to the vehicle 100 traveling at a speed above the predetermined threshold speed. In this case, the canceling sound may be generated before a buffeting noise is detected, to aid in preventing generation of a buffeting noise or to prevent a developing buffeting noise from reaching a predetermined sound level where the noise may become irritating to vehicle occupants. In one or more arrangements, the canceling sound may have the frequency $f^1$ and be equal in amplitude but opposite in phase to the buffeting noise. In cases where the buffeting sound is detected by buffeting noise detection sensors 185, the sensors may provide additional details (such as amplitude and/or phase information, aside from the frequency $f^1$) regarding the buffeting noise, which may be useful in generating a noise canceling sound.

The buffeting noise mitigation module 160 may then (in block 428) control operation of the noise cancelling signal generating system 142 to generate a sound having the characteristics configured to cancel the buffeting noise. For cases where the noise canceling sound is to be generated based on the fact that the vehicle is moving at a speed above the threshold speed with a single window open, test data may be compiled for each vehicle window and the sunroof, relating buffeting noise characteristics such as amplitude, phase, and other characteristics at various vehicle speeds with amounts by which the respective window is open. This information may be useful in generating a noise canceling sound. Such information may be stored in any suitable form (in the open window data 187, for example) for use in generating the noise canceling sound.

Returning to block 426, if there is not still only a single open window, control may pass to block 430 where the buffeting noise mitigation module 160 may determine if a noise-canceling sound is currently being generated. If a noise-canceling sound is currently being generated, the buffeting noise mitigation module 160 may (in block 432) stop generation of the noise canceling sound. This function controls the signal generator 143 so that a noise-canceling sound is generated only in cases where a single window (or the sunroof) is open.

Returning to block 424, if a noise-canceling sound is currently being generated when the vehicle is traveling at a speed above the predetermined threshold, control may pass to block 408, where the buffeting noise mitigation module 160 may determine if a single window of the vehicle is open, followed by repeating the loop as previously described to enable updating the noise-canceling signal generation parameters (if needed) and revise the characteristics of the generated sound accordingly.

Returning to block 406, and simultaneously with block 414, the buffeting noise mitigation module 160 may (in block 418) determine if the vehicle is traveling at a speed in excess of a predetermined threshold speed. Movement of the vehicle 100 at a speed in excess of a predetermined threshold speed may be used as an alternative criterion for generating a canceling noise as previously described (i.e., if a buffeting noise is not being detected by sensor(s) 185, a canceling noise may be generated responsive to the vehicle 100 traveling at a speed in excess of a predetermined threshold). If the vehicle is not traveling at a speed in excess of the predetermined threshold speed, control may pass to block 420, from which control may further proceed as previously described. If the vehicle is traveling at a speed in excess of a predetermined threshold speed, control may pass to block 424, from which control may further proceed as previously described.

In other aspects, disclosed herein is a method of actively mitigating a buffeting noise in an occupant compartment of a vehicle when the vehicle is moving. The method may include steps of determining an estimated effective volume of the occupant compartment, and determining if a single window of the occupant compartment is open. Responsive to a determination that a single window of the occupant compartment is open, and using the estimated effective volume of the occupant compartment, an estimated buffeting noise frequency may be determined. Using the estimated buffeting noise frequency, characteristics of a sound configured to cancel a buffeting noise inside the occupant compartment while the vehicle is moving may be determined. Operation of a noise cancelling signal generating system may then be controlled to generate the sound having characteristics configured to cancel the buffeting noise inside the occupant compartment.

In further aspects, the method may include the step of controlling operation of the signal generating system to generate the sound when the vehicle is traveling at a speed above a predetermined threshold. The method may also include the step of controlling operation of the signal generating system to stop generation of the sound when the vehicle speed falls below the predetermined threshold.

The method may also include the step of controlling operation of the signal generating system to generate the sound when a buffeting noise level detected within the occupant compartment is above a predetermined threshold. The method may also include the step of controlling operation of the signal generating system to stop generation of the sound if the buffeting noise level falls below the predetermined threshold.

The method may also include the steps of determining if a single window remains open, and responsive to a determination that a single window does not remain open, controlling operation of the signal generating system to stop generation of the sound configured to cancel the buffeting noise.

The method may also include the steps of estimating a nominal volume of the occupant compartment, estimating an added volume of objects residing in the occupant compartment, and using the nominal volume and the added volume of the objects, estimating the effective volume of the occupant compartment.

Detailed embodiments are disclosed herein. However, it is to be understood that the disclosed embodiments are intended only as examples. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations. Various embodiments are shown in FIGS. 1-4, but the embodiments are not limited to the illustrated structure or application.

The flowcharts and block diagrams in the figures illustrate the architecture, functionality, and operation of possible implementations of systems, methods, and computer program products according to various embodiments. In this regard, each block in the flowcharts or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The systems, components and/or processes described above can be realized in hardware or a combination of hardware and software and can be realized in a centralized fashion in one processing system or in a distributed fashion where different elements are spread across several interconnected processing systems. Any kind of processing system or another apparatus adapted for carrying out the methods described herein is suited. A typical combination of hardware and software can be a processing system with computer-usable program code that, when being loaded and executed, controls the processing system such that it carries out the methods described herein. The systems, components and/or processes also can be embedded in a computer-readable storage, such as a computer program product or other data programs storage device, readable by a machine, tangibly embodying a program of instructions executable by the machine to perform methods and processes described herein. These elements also can be embedded in an application product which comprises all the features enabling the implementation of the methods described herein and, which when loaded in a processing system, is able to carry out these methods.

Furthermore, arrangements described herein may take the form of a computer program product embodied in one or more computer-readable media having computer-readable program code embodied, e.g., stored, thereon. Any combination of one or more computer-readable media may be utilized. The computer-readable medium may be a computer-readable signal medium or a computer-readable storage medium. The phrase "computer-readable storage medium" means a non-transitory storage medium. A computer-readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer-readable storage medium would include the following: a portable computer diskette, a hard disk drive (HDD), a solid-state drive (SSD), a read-only memory (ROM), an erasable programmable read-only memory (EPROM or Flash memory), a portable compact disc read-only memory (CD-ROM), a digital versatile disc (DVD), an optical storage device, a magnetic storage device, or any suitable combination of the foregoing. In the context of this document, a computer-readable storage medium may be any tangible medium that can contain, or store a program for use by or in connection with an instruction execution system, apparatus, or device.

Generally, modules as used herein include routines, programs, objects, components, data structures, and so on that perform particular tasks or implement particular data types. In further aspects, a memory generally stores the noted modules. The memory associated with a module may be a buffer or cache embedded within a processor, a RAM, a ROM, a flash memory, or another suitable electronic storage medium. In still further aspects, a module, as envisioned by the present disclosure, is implemented as an application-specific integrated circuit (ASIC), a hardware component of a system on a chip (SoC), as a programmable logic array (PLA), or as another suitable hardware component that is embedded with a defined configuration set (e.g., instructions) for performing the disclosed functions.

Program code embodied on a computer-readable medium may be transmitted using any appropriate medium, including but not limited to wireless, wireline, optical fiber, cable, RF, etc., or any suitable combination of the foregoing. Computer program code for carrying out operations for aspects of the present arrangements may be written in any combination of one or more programming languages, including an object-oriented programming language such as Java™, Smalltalk, C++ or the like and conventional procedural programming languages, such as the "C" programming language or similar programming languages. The program code may execute entirely on the operator's computer, partly on the operator's computer, as a stand-alone software package, partly on the operator's computer and partly on a remote computer, or entirely on the remote computer or server. In the latter scenario, the remote computer may be connected to the operator's computer through any type of network, including a local area network (LAN) or a wide area network (WAN), or the connection may be made to an external computer (for example, through the Internet using an Internet Service Provider).

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The phrase "at least one of . . . and . . . " as used herein refers to and encompasses any and all possible combinations of one or more of the associated listed items. As an example, the phrase "at least one of A, B, and C" includes A only, B only, C only, or any combination thereof (e.g., AB, AC, BC or ABC).

Aspects herein can be embodied in other forms without departing from the spirit or essential attributes thereof. Accordingly, reference should be made to the following claims, rather than to the foregoing specification, as indicating the scope hereof.

What is claimed is:

1. A system for actively mitigating a buffeting noise in an occupant compartment of a vehicle when the vehicle is moving, the system comprising:

one or more processors; and a memory communicably coupled to the one or more processors and storing a buffeting noise mitigation module including computer-readable instructions that when executed by the one or more processors cause the one or more processors to:

determine an estimated effective volume of the occupant compartment;

determine if a single window of the vehicle occupant compartment is open;

responsive to a determination that a single window of the vehicle occupant compartment is open, and using the estimated effective volume of the occupant compartment, determine an estimated buffeting noise frequency;

responsive to the estimated buffeting noise frequency, determine characteristics of a sound configured to cancel a buffeting noise generated inside the occupant compartment while the vehicle is moving; and control operation of a noise cancelling signal generating system to generate the sound having characteristics configured to cancel the buffeting noise inside the occupant compartment.

2. The system of claim 1 wherein the buffeting noise mitigation module includes computer-readable instructions that when executed by the one or more processors cause the one or more processors to control operation of the signal generating system to generate the sound when the vehicle is traveling at a speed above a predetermined threshold.

3. The system of claim 2 wherein the buffeting noise mitigation module includes computer-readable instructions that when executed by the one or more processors cause the one or more processors to control operation of the signal generating system to stop generation of the sound when the vehicle speed falls below the predetermined threshold.

4. The system of claim 1 wherein the buffeting noise mitigation module includes computer-readable instructions that when executed by the one or more processors cause the one or more processors to control operation of the signal generating system to generate the sound when a buffeting noise level detected within the occupant compartment is above a predetermined threshold.

5. The system of claim 4 wherein the buffeting noise mitigation module includes computer-readable instructions that when executed by the one or more processors cause the one or more processors to control operation of the signal generating system to stop generation of the sound if the buffeting noise level falls below the predetermined threshold.

6. The system of claim 1 wherein the buffeting noise mitigation module includes computer-readable instructions that when executed by the one or more processors cause the one or more processors to:

determine if a single window remains open; and responsive to a determination that a single window does not remain open, control operation of the signal generating system to stop generation of the sound configured to cancel the buffeting noise.

7. The system of claim 1 wherein the buffeting noise mitigation module includes computer-readable instructions that when executed by the one or more processors cause the one or more processors to:

estimate a nominal volume of the occupant compartment;

estimate an added volume of objects residing in the occupant compartment; and using the nominal volume and the added volume of the objects, estimate the effective volume of the occupant compartment.

8. A method of actively mitigating a buffeting noise in an occupant compartment of a vehicle when the vehicle is moving, the method comprising steps of:

determining an estimated effective volume of the occupant compartment;

determining if a single window of the occupant compartment is open;

responsive to a determination that a single window of the occupant compartment is open, and using the estimated effective volume of the occupant compartment, determining an estimated buffeting noise frequency;

using the estimated buffeting noise frequency, determining characteristics of a sound configured to cancel a buffeting noise inside the occupant compartment while the vehicle is moving; and controlling operation of a noise cancelling signal generating system to generate the sound having characteristics configured to cancel the buffeting noise inside the occupant compartment.

9. The method of claim 8 further comprising the step of controlling operation of the signal generating system to generate the sound when the vehicle is traveling at a speed above a predetermined threshold.

10. The method of claim 9 further comprising the step of controlling operation of the signal generating system to stop generation of the sound when the vehicle speed falls below the predetermined threshold.

11. The method of claim 8 further comprising the step of controlling operation of the signal generating system to generate the sound when a buffeting noise level detected within the occupant compartment is above a predetermined threshold.

12. The method of claim 11 further comprising the step of controlling operation of the signal generating system to stop generation of the sound if the buffeting noise level falls below the predetermined threshold.

13. The method of claim 8 further comprising the steps of:

determining if a single window remains open; and responsive to a determination that a single window does not remain open, controlling operation of the signal generating system to stop generation of the sound configured to cancel the buffeting noise.

14. The method of claim 8 further comprising the steps of:

estimating a nominal volume of the occupant compartment;

estimating an added volume of objects residing in the occupant compartment; and using the nominal volume and the added volume of the objects, estimating the effective volume of the occupant compartment.

15. A non-transitory computer readable medium having stored therein instructions, that when executed by one or more processors cause the one or more processors to:

determine an estimated effective volume of an occupant compartment of a vehicle;

determine if a single window of the occupant compartment is open;

responsive to a determination that a single window of the occupant compartment is open, and using the estimated effective volume of the occupant compartment, determine an estimated buffeting noise frequency;

using the estimated buffeting noise frequency, determine characteristics of a sound configured to cancel a buffeting noise inside the occupant compartment while the vehicle is moving; and control operation of a vehicle noise cancelling signal generating system to generate the sound having characteristics configured to cancel the buffeting noise inside the occupant compartment.

16. The non-transitory computer readable medium of claim 15 wherein the instructions to control operation of the signal generating system include instructions to control operation of the system to generate the sound when the vehicle is traveling at a speed above a predetermined threshold.

17. The non-transitory computer readable medium of claim 15 wherein the instructions to control operation of the signal generating system include instructions to control operation of the system to generate the sound when a buffeting noise level detected within the occupant compartment is above a predetermined threshold.

18. The non-transitory computer readable medium of claim 15 further including instructions that when executed by one or more processors cause the one or more processors to:

estimate a nominal volume of the occupant compartment;

estimate an added volume of objects residing in the occupant compartment; and using the nominal volume and the added volume of the objects, estimate the effective volume of the occupant compartment.

* * * * *